US007270135B2

(12) United States Patent
Virgilio et al.

(10) Patent No.: US 7,270,135 B2
(45) Date of Patent: Sep. 18, 2007

(54) DISHWASHER DISPENSING ASSEMBLY ACTUATOR MECHANISM

(75) Inventors: Stephen Virgilio, Mount Prospect, IL (US); Robert Dam, Aurora, IL (US)

(73) Assignee: Illinois Tool Works Inc., Glenview, IL (US)

( * ) Notice: Subject to any disclaimer, the term of this patent is extended or adjusted under 35 U.S.C. 154(b) by 632 days.

(21) Appl. No.: 10/684,961

(22) Filed: Oct. 14, 2003

(65) Prior Publication Data

US 2004/0118434 A1 Jun. 24, 2004

Related U.S. Application Data

(60) Provisional application No. 60/418,058, filed on Oct. 15, 2002.

(51) Int. Cl.
*B08B 3/02* (2006.01)

(52) U.S. Cl. ..... 134/93; 68/17 R

(58) Field of Classification Search ..... 134/93; 68/207, 17 R

See application file for complete search history.

(56) References Cited

U.S. PATENT DOCUMENTS 4,490,975 A * 1/1985 Yaeger et al. ..... 60/527
4,524,343 A * 6/1985 Morgan et al. ..... 337/140
4,551,975 A * 11/1985 Yamamoto et al. ..... 60/528
4,965,545 A * 10/1990 Johnson ..... 337/140
6,058,946 A * 5/2000 Bellati et al. ..... 134/25.2
6,851,260 B2 * 2/2005 Mernøe ..... 60/527
6,955,067 B2 * 10/2005 Davenet et al. ..... 68/17 R
2003/0051513 A1 * 3/2003 Castelli et al. ..... 68/12.18

FOREIGN PATENT DOCUMENTS

| | | | |
|---|---|---|---|
| DE | 40 12 579 | * | 10/1991 |
| JP | 61-58689 | * | 3/1986 |
| JP | 1-206582 | * | 8/1989 |
| JP | 3-297435 | * | 12/1991 |
| JP | 5-221468 | * | 8/1993 |
| JP | 5-221469 | * | 8/1993 |
| JP | 9-140654 | * | 6/1997 |
| JP | 10-55217 | * | 2/1998 |
| JP | 2000-300498 | * | 10/2000 |

* cited by examiner

*Primary Examiner*—Frankie L. Stinson
(74) *Attorney, Agent, or Firm*—Mark W. Croll; Paul F. Donovan

(57) ABSTRACT

An actuator mechanism is provided for a dishwasher dispensing assembly including a detergent dispenser actuator and a rinse agent dispenser actuator. Shape memory wire is connected to each actuator and is used to open a detergent reservoir and a rinse aid reservoir by operating the actuator through contraction of the shape memory wire.

7 Claims, 2 Drawing Sheets

DISHWASHER DISPENSING ASSEMBLY ACTUATOR MECHANISM

CROSS REFERENCE TO RELATED APPLICATION

This application claims benefit to U.S. Provisional Patent Application Ser. No. 60/418,058 filed Oct. 15, 2002.

FIELD OF THE INVENTION

The present invention pertains generally to automatic dishwashers, and, more particularly to actuator mechanisms in dispensing assemblies for detergent and rinse agent reservoirs in automatic dishwashers.

BACKGROUND OF THE INVENTION

High-end residential dishwashers have dispensing assemblies mounted in the inside surface of the appliance door. The dispensing assembly dispenses both detergent and rinse agent at appropriate times during a wash cycle. The assembly has two separate compartments or reservoirs, one for each ingredient, with actuator mechanisms to release each agent.

Detergent is added to the dispensing assembly with every load of dishes. A spring-loaded door covers the detergent compartment. In an unlatch mode, the door is open. The consumer adds detergent to the compartment prior to the wash cycle. The door is manually closed and is latched automatically by a spring-loaded pawl. A solenoid or wax motor electrically operates the pawl, to unlatch the door at the proper time during the wash cycle. A spring biases the door open to release the detergent for washing.

The rinse agent compartment consists of a reservoir with a filler cap. The consumer removes the filler cap to add rinse agent. Since only a very small amount of rinse agent is used to wash each load of dishes, rinse agent is only added periodically. During a specific wash cycle, rinse agent is emitted from the reservoir through a port that leads to the exterior surface of the dispensing assembly. It is known to open and close the port via a spring-loaded plunger valve. The normal state of the valve is closed. Opening the valve allows rinse agent to flow through the port and into the dishwasher. The valve can be operated by the same solenoid or wax motor that operates the detergent compartment door, or by a different wax motor or solenoid.

The dispensing assembly is controlled by the dishwasher electronic control module or by an electromechanical timer. With the dispenser loaded with detergent and rinse agent and the appliance door secured, the dishwasher cycle of operation begins. As the wash cycle is reached, the solenoid or wax motor is energized, and the spring-loaded pawl moves to its unlatched position. This releases the detergent door, which springs open to introduce the detergent into the dishwasher. As the solenoid or wax motor is de-energized, the spring-loaded pawl returns to its default latched position while the door itself remains open for the duration of the operating cycle.

As the rinse cycle is reached, the solenoid or wax motor is energized a second time, and the spring-loaded plunger valve is opened. Rinse agent is allowed to flow through the port and is introduced into the dishwasher. As the solenoid or wax motor is de-energized, the valve returns to its default closed position and stems the flow of rinse agent.

To avoid operation of the rinse agent plunger valve during the first actuation, dispensers employing a wax motor use an elaborate system of linkages and springs combined with an alternate-action latching feature. Dispensers using solenoids simply allow the rinse agent valve to open during the very brief first actuation. The cycle time to operate a wax motor is much longer, requiring up to about ten seconds, than is that of a solenoid, which is virtually instantaneous. However, even a very brief open and close of the rinse agent valve at the start of the wash cycle can be wasteful over time and many wash cycles.

Although wax motors and solenoids have operated effectively on dishwasher dispensing assemblies, certain disadvantages are associated with the use of each. Solenoids and wax motors are expensive and relatively large. It is desirable to reduce the profile of components housed in the dishwasher panels and door to maximize the open internal volume for holding dishes. The linkage systems from the wax motor or solenoid can be complex. Operating noise levels can be high. Reduced cost, decreased weight, reduced disposal hazards and improved reliability are further goals for all such devices.

What is needed in the art is a compact, low cost and reliable actuator mechanism for detergent and rinse aid dispenser assemblies in automatic dishwashers.

SUMMARY OF THE INVENTION

The present invention meets the aforementioned needs and other needs by providing an actuator mechanism using shape memory alloy in the form of wire to actuate door latches for detergent dispensers and plunger valves for rinse agent dispensers in automatic dishwasher dispensing assemblies.

In one form thereof, the present invention provides a dishwasher dispensing assembly for dispensing an additive during a wash cycle of the dishwasher. The dispensing assembly has a reservoir for holding the additive, and a dispenser actuator configured to selectively open an outlet of the reservoir upon movement of the actuator. A shape memory wire adapted to contract in length upon application of an electric current thereto and to elongate upon interruption of the current thereto, is connected to the actuator for causing movement of the actuator by contraction of the wire.

In another form thereof, the present invention provides a dishwasher dispensing assembly with a detergent reservoir for holding detergent to be dispensed during a washing cycle and a detergent dispenser actuator including a lever configured to open an outlet of the detergent reservoir upon movement of the lever. A rinse agent reservoir is provided for holding rinse agent to be dispensed during a washing cycle, and a rinse agent dispenser actuator includes a valve having a stem configured to open an outlet of the rinse agent reservoir upon movement of the stem. First and second shape memory wires are provided, adapted to contract in length upon application of an electric current thereto and to elongate upon interruption of the current thereto. One of the shape memory wires is connected to the detergent dispenser actuator for causing movement of the detergent dispenser actuator by contraction of the wire. The other of the shape memory wires is connected to the rinse agent dispenser actuator for causing movement of the rinse agent dispenser actuator by contraction of the wire connected to it.

In yet another form thereof, the present invention provides a method for controllably dispensing an additive to a dishwasher cycle. The method has steps of providing a dispensing assembly having at least one reservoir and an actuator configured to open an outlet of the reservoir upon movement of the actuator; providing a shape memory wire connected to the actuator, the shape memory wire being responsive to a temperature thereof to change a length thereof; and moving the actuator for releasing the agent from the reservoir by selectively directing an electric current to the shape memory wire and changing a length of the shape memory wire.

An advantage of the present invention is providing a simple, low cost actuator mechanism for dispenser assemblies in automatic dishwashers.

Another advantage of the present invention is providing a compact, low profile actuator mechanism for dispensing assemblies in automatic dishwashers that fits readily between door panels.

Yet another advantage of the present invention is providing a lightweight actuator mechanism for dispenser assemblies in automatic dishwashers, which has a long expected useful life and operates quietly.

Still another advantage of the present invention is providing an actuator mechanism for dispensing assemblies in automatic dishwashers that operates efficiently and reliably in a variety of dispensing assembly configurations, with reduced energy requirements.

Other features and advantages of the invention will become apparent to those skilled in the art upon review of the following detailed description, claims and drawings in which like numerals are used to designate like features.

Figure 1:
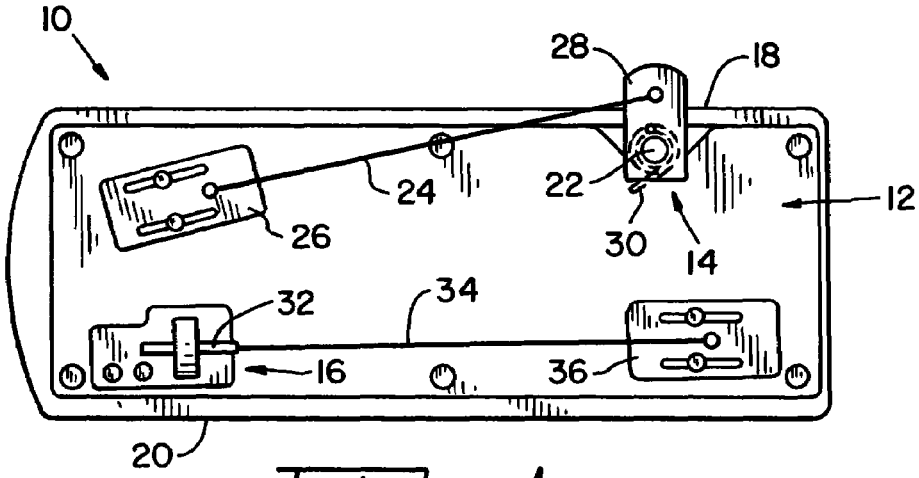
FIG. 1 is a plan view of a dishwasher dispensing assembly using an actuator mechanism in accordance with the present invention, the mechanism shown in a first condition of operation.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including" and "comprising" and variations thereof is meant to encompass the items listed thereafter and equivalents thereof, as well as additional items and equivalents thereof.

DETAILED DESCRIPTION OF THE PREFERRED EMBODIMENT

Figure 2:
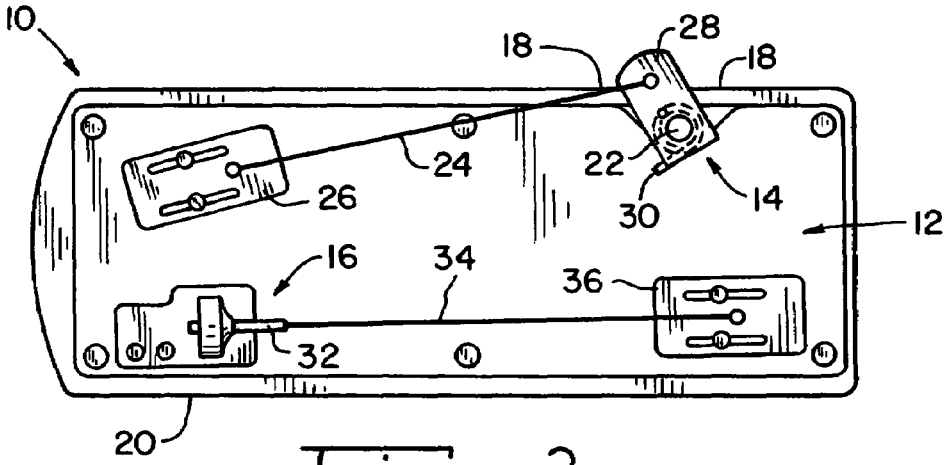
FIG. 2 is a plan view of the dishwasher dispensing assembly shown in FIG. 1, but illustrating the actuator mechanism in a second condition of operation.

Referring now more specifically to the drawings, and to FIGS. 1 and 2 in particular, numeral 10 designates a dishwasher dispensing assembly having an actuator mechanism 12 in accordance with the present invention. Actuator mechanism 12 includes a detergent dispenser actuator 14 and a rinse agent dispenser actuator 16. Dispensing assembly 10 further includes a detergent reservoir 18 and a rinse agent reservoir 20 having controllable outlets therefrom, as those skilled in the art will understand readily.

Those skilled in the art will readily understand further that the form, configuration and shape of dishwasher dispensing assembly 10, including the arrangement and shapes of reservoirs 18 and 20, can vary substantially from manufacturer to manufacturer, and from one model to another model of dishwasher. Actuator mechanisms according to the present invention can be adapted for effective performance with different designs and configurations of dispensing assemblies 10.

As known to those skilled in the art, detergent reservoir 18 defines a compartment for reception of detergent, which is loaded into detergent reservoir 18 prior to commencement of each washing cycle. Detergent reservoir 18 commonly includes a door biased to an open position, and a releasable latch mechanism holding the door in a closed position. At an appropriate time during the wash cycle, a spring-loaded latch mechanism, including a pawl connected to a rotatable shaft 22, is actuated to release the latch mechanism, open the door and expose the detergent for discharge into the dishwasher.

In accordance with the present invention, detergent dispenser actuator 14 includes a length of shape memory wire 24 disposed between a fixed anchor 26 and a pivoting lever 28 connected to pawl shaft 22. A spring 30 biases rotation of lever 28 in a clockwise direction as shown in FIGS. 1 and 2, that is, spring 30 biases rotation of lever 28 so as to provide tension on shape memory wire 24.

Rinse agent reservoir 20 contains multiple dosage quantities of rinse agent provided to improve sheeting of water and lessening the formation of water spots on the drying dishes. The reservoir, in known fashion, has a passage-way to dispense controlled amounts of rinse agent into the washing chamber, with a valve gate provided to control release of the rinse agent into the dishwasher. Commonly, plunger valves are used, but other dispensing means are also known. A valve stem 32 is provided, the movement of which opens and closes the valve. Conventionally, the valve is biased to a closed position by a spring or resiliency of the valve head itself. Rinse agent dispenser actuator 16 includes a length of shape memory wire 34 attached at one end to a fixed anchor 36 and attached at an opposite end to valve stem 32.

Shape memory material suitable for use as lengths of shape memory wire 24 and 34 is a known material, referred to as shape memory alloys, such as nickel titanium alloy which, when heated contracts in length. Transition is rapid at the transition temperature, which is determined by the ratio of nickel to titanium in the alloy. Wires of shape memory alloy can be made to contract an amount based on a percentage of the relaxed wire length, such as for example, 5% to 10%. Shape memory alloys commonly have a high electrical resistance, and can be heated to the transition temperature by passing an electric current therethrough. By controlling a flow of electricity through shape memory wires 24 and 34, accurate operation thereof is made to cause the wires to selectively contract, thereby rotating lever 28 and moving valve stem 32 axially. Upon interruption of the flow of electric current through shape memory wires 24 or 34, rapid cooling occurs and elongation of the wires results, thereby allowing lever 28 to rotate and valve stem 32 to move axially in response to the biasing forces applied on each, such as by spring 30 on lever 28.

Under proper operating conditions, the shrinkage factor of shape memory wire is accurate and repeatable at the transition temperature over a prolonged life (e.g., more than one million cycles). A bias force is provided to the wire in the directions of elongation to assist in returning the wire to the relaxed state and the relaxed dimensions thereof. Thus, the commonly provided biasing forces on lever 28 and valve stem 32 cooperate with shape memory wire lengths 24 and 34 for prolonged accurate operation.

FIG. 1 illustrates dishwasher dispensing assembly 10 in a condition of operation in which detergent dispenser actuator 14 and rinse agent dispenser actuator 16 are both in so called "closed" positions. Shape memory wire 24 and shape memory wire 34 are in their elongated, relaxed conditions. FIG. 2 illustrates the activated positions of shape memory wires 24 and 34. Wires 24 and 34 are shortened, lever 28 has been rotated counterclockwise with respect to the position shown in FIG. 1, and valve stem 32 has been moved axially toward fixed anchor 36 in comparison to the position shown in FIG. 1. The manner in which pawl shaft 22 and valve stem 32 are connected to and operate with appropriate outlet mechanisms for operating detergent reservoir 18 and rinse agent reservoir 20, respectively, are well-known to those skilled in the art and will not be described in further detail herein.

Figure 3:
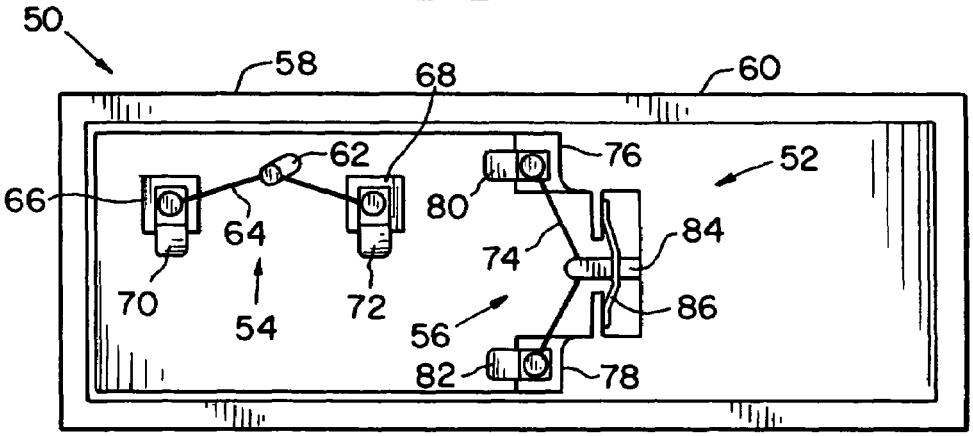
FIG. 3 is a plan view of a dishwasher dispensing assembly having a second embodiment of an actuator mechanism in accordance with the present invention, illustrated in a first condition of operation.
Figure 4:
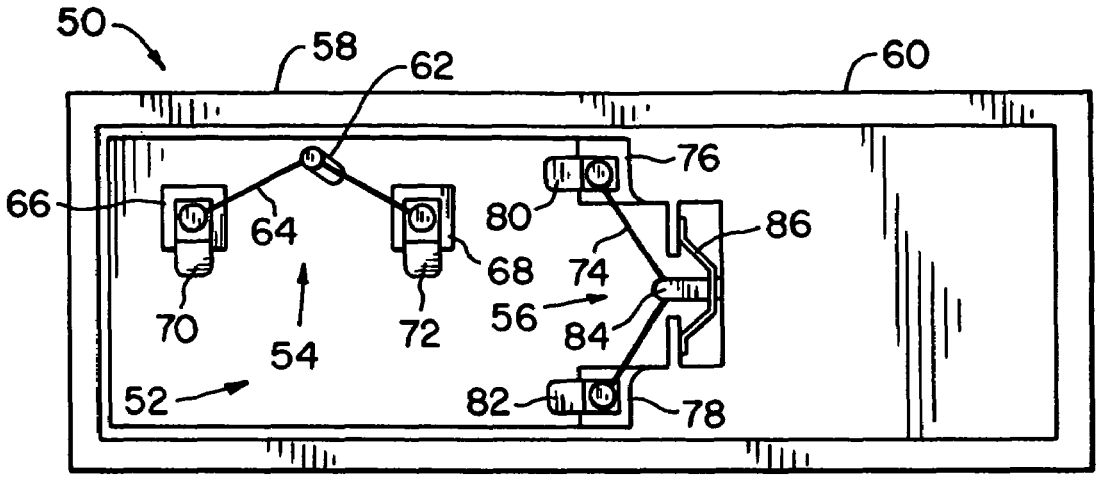
FIG. 4 is a plan view of the dishwasher dispensing assembly shown in FIG. 3, but illustrating the actuator mechanism in a second condition of operation.

In the embodiment shown in FIGS. 1 and 2, shape memory wires 24 and 34 each are connected between a fixed anchor 26 and 36, respectively, and a movable element at an opposite end thereof, such as lever 28 and valve stem 32, respectively. Thus, one end of each wire 24 and 34 is fixed in position, and the other end of each wire is moveable, to pull on a movable element connected at the movable ends of wires 24 and 34. FIGS. 3 and 4 illustrate an alternative embodiment in which the movable components are connected to shape memory wire at an intermediate position along the shape memory wire, which is fixed between two fixed anchors, one at each end of the wire.

Second embodiment dispensing assembly 50 includes an actuator mechanism 52 having a detergent dispenser actuator 54 and a rinse agent dispenser actuator 56 operating on detergent reservoir 58 and rinse agent reservoir 60, respectively.

Detergent dispenser actuator 54 includes an offset pawl actuator 62. A length of shape memory wire 64 extends through a hole in pawl actuator 62 and is connected between fixed anchors 66 and 68 having electrical terminals 70 and 72, respectively. Pawl actuator 62 is positioned substantially equidistant between fixed anchors 66 and 68, but not in a straight line relationship between anchors 66 and 68. Thus, an angle is defined in shape memory wire 64 at pawl actuator 62, and a triangular relationship is established between fixed anchors 66 and 68 and pawl actuator 62. Advantageously, shape memory wire 64 passes through a hole in pawl actuator 62 that allows limited relative movement of shape memory wire 64 through pawl actuator 62.

When electric current is provided via circuit connections at terminals 70 and 72, shape memory wire 64 is heated and in the excited state contracts in length. Thus, the angle defined in shape memory wire 64 at pawl actuator 62 is flattened, and pawl actuator 62 is caused to rotate as illustrated in FIGS. 3 and 4. FIG. 3 illustrates detergent dispenser actuator 54 in the "activated" state and FIG. 4 illustrates detergent dispenser actuator 54 in the unactivated or relaxed state. With a reasonable length of shape memory wire 64 and appropriate geometry provided by fixed anchors 66 and 68 and pawl actuator 62, pawl actuator 62 can be caused to rotate through approximately 30 degrees of rotation between the actuated and non-actuated conditions of shape memory wire 64.

Rinse agent dispenser actuator 16 includes a length of shape memory wire 74 secured at opposite ends to fixed anchors 76 and 78 having electrical terminals 80 and 82, respectively. A valve stem 84 controllably connected for the release of rinse agent is provided substantially equidistant between fixed anchors 76 and 78 and includes a hole through which shape memory wire 74 is passed. Again, fixed anchors 76, 78 and valve stem 84 are arranged in a triangular relationship, such that an angle is formed in shape memory wire 74 at valve stem 84. Electric current is provided to shape memory wire 74 by electrical circuit connections at terminals 70 and 72. As electricity passes through shape memory wire 74 and shape memory wire 74 reaches an excited state, the length thereof is diminished, causing a flattening of the angle formed in shape memory wire 74 at valve stem 84. Valve stem 84 is thereby moved axially. Upon termination of the flow of electric current through shape memory wire 74, elongation again occurs and valve stem 84 moves by its natural biasing force away from a straight line defined between anchors 76 and 78. Alternatively, a leaf spring 86 can be provided.

With appropriate lengths of shape memory wire 64 and 74 and the appropriate geometric relationships between fixed anchors 66 and 68 with pawl actuator 62 and fixed anchors 76 and 78 with valve stem 84, an achievable 5% change in the length of shape memory wire 64 or 74 can cause a rotation of approximately 30% by pawl actuator 62 and movement of valve stem 84 sufficient to move a plunger and align the opening of a port to release rinse agent into the dishwasher.

The use of shape memory wire in actuator mechanisms for dishwasher dispensing assemblies is accurate, reliable and fast acting as compared with wax motors and solenoids. The lifecycle expectancy exceeds that of the dishwasher itself. The narrow profile achievable with the present invention fits readily within the space defined between inner and outer skins of a dishwasher door.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A dishwasher dispensing assembly for dispensing an additive during a wash cycle of the dishwasher, said assembly comprising:

a reservoir for holding the additive;

a dispenser actuator configured to selectively open an outlet of said reservoir upon movement of said actuator, a shape memory wire adapted to contact in length upon application of a electric current thereto and to elongate upon interruption of the current thereto, said shape memory wire being connected to said actuator for causing movement of said actuator by contraction of said wire; and the dishwasher dispensing assembly further including first and second reservoirs having first and second dispenser actuators respectively; and first and second shape memory wires adapted to contract in length upon application of an electric current thereto and to elongate upon interruption of the current thereto, said first and second shape memory wires being connected to said first and second actuators, respectively, for causing movement of said actuators by contraction of said wires each said shape memory wire having a first end connected to a fixed anchor and a second end connected to one of said actuators, one of said first and second actuators comprising a lever for rotating a shaft said lever being connected to one of said shape memory wires; and the other of said actuators comprising a plunger valve having a stem connected to the other of said shape memory wires.

2. A dishwasher dispensing assembly for dispensing an additive during a wash cycle of the dishwasher, said dispensing assembly comprising:

a reservoir for holding the additive;

a dispenser actuator configured to selectively open an outlet of said reservoir upon movement of said actuator;

a shape memory wire adapted to contract in length upon application of an electric current thereto and to elongate upon interruption of the current thereto, said shape memory wire being connected to said actuator for causing movement of said actuator by contraction of said wire; and the dishwasher dispensing assembly further including first and second reservoirs having first and second dispenser actuators respectively: and first and second shape memory wires adapted to contract in length upon application of an electric current thereto and to elongate upon interruption of the current thereto, said first and second shape memory wires being connected to said first and second actuators, respectively, for causing movement of said actuators by contraction of said wires, one of said first and second actuators comprising a lever for rotating a shaft, said lever being connected to one of said shape memory wires; and the other of said actuators comprising a plunger valve having a stem connected to the other of said shape memory wires.

3. The dishwasher dispensing assembly of claim 2, each said shape memory wire having a first end connected to a first fixed anchor and a second end connected to a second fixed anchor, and said first and second actuators connected to said first and second shape memory wires, respectively between said first and second ends of said wires, in non linear alignment with the respective ends thereof.

4. The dishwasher dispensing assembly of claim 3, said actuators connected to said shape memory wire in nonlinear alignment between said first and second ends.

5. A dishwasher dispensing assembly, comprising:

a detergent reservoir for holding detergent to be dispensed during a washing cycle;

a detergent dispenser actuator including a lever configured to open an outlet of said detergent reservoir upon movement of said lever;

a rinse agent reservoir for holding rinse agent to be dispensed during a washing cycle;

a rinse agent dispenser actuator including a valve having a stem configured to open an outlet of said rinse agent reservoir upon movement of said stem; and first and second shape memory wires adapted to contract in length upon application of an electric current thereto and to elongate upon interruption of the current thereto, one of said shape memory wires being connected to said detergent dispenser actuator for causing movement of said detergent dispenser actuator by contraction of said one of said wires, and the other of said shape memory wires being connected to said rinse agent dispenser actuator for casing movement of said use agent dispenser actuator by contraction of said other of said wires.

6. The dishwasher dispersing assembly of claim 5, at least one of said shape memory wires having one end thereof connected to a fixed anchor end thereof connected to one of said actuators.

7. The dishwasher dispensing assembly of claim 5, at least one of said shape memory wires having one end thereof connected to a first fixed anchor and a second end thereof connected to a second fixed anchor, and one of said actuators connected to said at least one of said shape memory wires intermediate said first and second ends and in nonlinear alignment between said first and second ends.

* * * * *